United States Patent [19]

Stahl

[11] 4,363,642

[45] Dec. 14, 1982

[54] CONTROL OF RANGE HOOD EMISSIONS

[75] Inventor: Lawrence E. Stahl, Rocky Mount, N.C.

[73] Assignee: Hardee's Food Systems, Inc., Rocky Mount, N.C.

[21] Appl. No.: 781,418

[22] Filed: Mar. 25, 1977

[51] Int. Cl.[3] ..... B01D 47/00

[52] U.S. Cl. ..... 55/233; 126/299 E; 55/DIG. 36; 55/242

[58] Field of Search ..... 55/DIG. 36, 233, 242; 126/299 E

[56] References Cited

U.S. PATENT DOCUMENTS

| | | | |
|---|---|---|---|
| 3,763,631 | 10/1973 | Horn et al. | 55/96 |
| 3,805,685 | 4/1974 | Carng | 55/274 |
| 3,854,388 | 12/1974 | King | 55/DIG. 36 |
| 3,907,525 | 9/1975 | King | 55/DIG. 36 |
| 4,011,101 | 3/1977 | Levenbach et al. | 126/299 E |
| 4,036,994 | 7/1977 | Ear | 426/233 |
| 4,040,042 | 8/1977 | Mayer | 55/274 |
| 4,050,291 | 9/1977 | Nelson | 55/274 |
| 4,066,064 | 1/1978 | Vandas | 55/DIG. 36 |
| 4,084,947 | 4/1978 | Ear | 55/DIG. 36 |
| 4,120,671 | 10/1978 | Steinmeyer | 55/242 |

OTHER PUBLICATIONS

O.G. vol. 969, No. 3 of the U.S. Patent & Trademark Office, 4/18/78, pp. 1029 & 1030.

*Primary Examiner*—Norman Yudkoff

*Attorney, Agent, or Firm*—Cushman, Darby & Cushman

[57] ABSTRACT

In a preferred form a restaurant meat broiling range hood is integrated with a fiber bed-type mist eliminating apparatus. Assistance is provided in the preferred form by a pump to draw the gas stream through this apparatus. Electrical and plumbing control systems are shown provided as substantially pre-assembled units for ease of field installation. A unique cleaning system is provided, which is simple to conduct.

18 Claims, 10 Drawing Figures

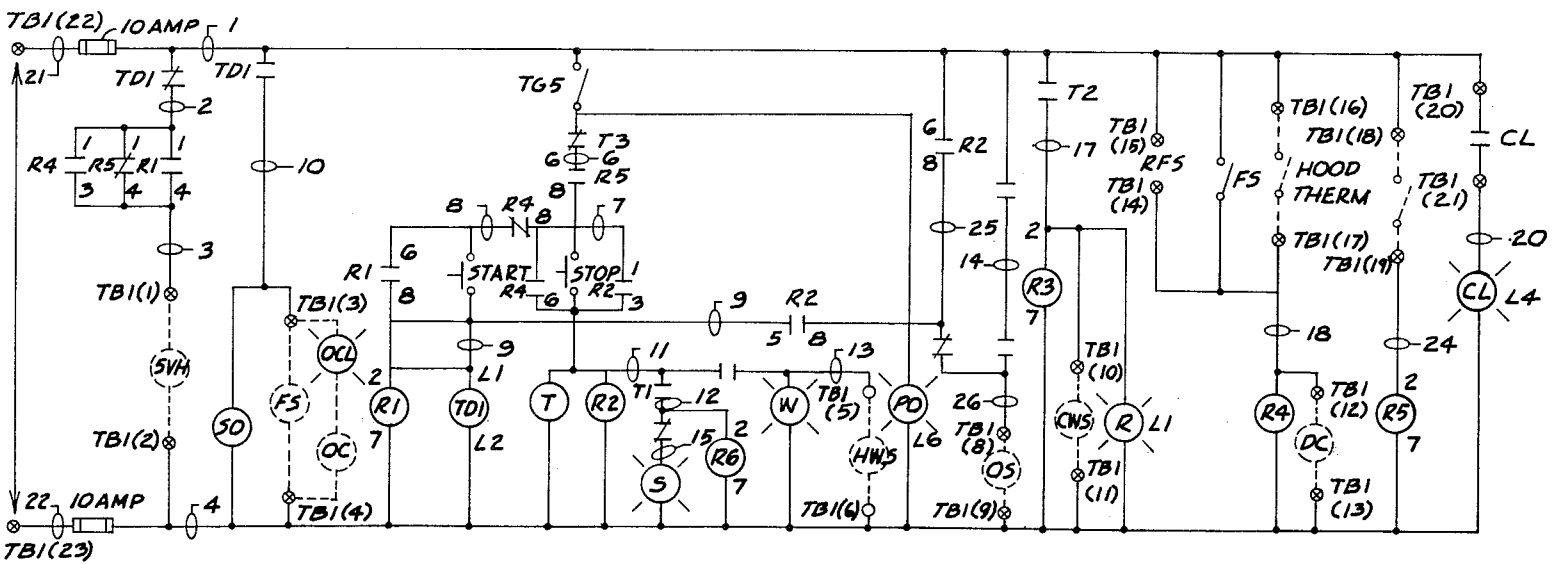
FIG. 5
LEGEND:
TB1 - TERMINAL BLOCK ONE
L1 - RINSE LIGHT
L2 - SOAK LIGHT
L3 - WASH LIGHT
L4 - DETERGENT LEVEL LIGHT
L5 - SYSTEM ON LIGHT
L6 - POWER ON LIGHT
R1-R6 - CONTROL RELAYS
TD1-TD10 - MIN. ADJUST. TIMER
T - SYNC. MOTOR CAM TIMER
F1-F2 - 10 AMP FUSES
TG5 - TOGGLE SWITCH
FS - FIRE SWITCH
START - START PUSH BUTTON
STOP - STOP PUSH BUTTON
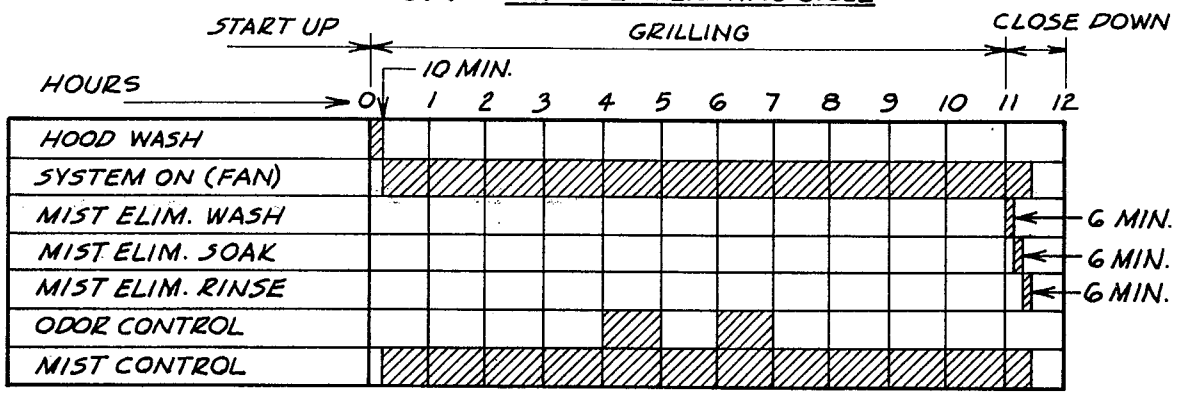
FIG. 7 TYPICAL OPERATING CYCLE

CONTROL OF RANGE HOOD EMISSIONS

BACKGROUND OF THE INVENTION

Much background is provided in the copending U.S. Patent application of Ear, Ser. No. 560,593, filed Mar. 21, 1975 (now U.S. Pat. No. 4,036,064, issued July 19, 1977) and is here incorporated, for sake of brevity.

When hamburgers or steaks are cooked on a char broiler the fat is rendered from the meat which drops to the ceramic or metal radiants, then the heat causes the fat juice droplets to partially burn and form aerosol to sub-micron particles. As these lighter particles rise, some penetrate the meat imparting the flavor but the vast majority rise and are evacuated into the exhaust system. Flat grill cooking does, especially with frozen product, create smoke as the meat juices and rendered fat become aerosol and rise and enter the hood ventilation system.

Although fiber bed-type mist eliminating apparatus may not yet be widely known, such apparatus is currently available. A method for cleaning such apparatus, in an industrial process such as sulfite paper making, is described in the U.S. Pat. No. of Huillet et al., 4,003,726, issued Jan. 18, 1977.

One current supplier of such devices is the Brink mist eliminator available from Monsanto Enviro-Chem Systems, Inc. Another source is identified in the aforesaid Huillet et al. patent.

It is an objective in the restaurant industry, where a lot of energy is unleashed but only partially consumed in the food preparation processes, to recapture some of the exhausted heat. In the grilling of meat, much of this energy is lost in the range hood exhaust stream. Many attempts have been made to recapture some of that heat, for heating or cooling the building and/or for hot water service, by the use of a heat transfer device interfaced between the hood exhaust gas stream and the restaurant heating and air conditioning distribution system. Heretofore attempts in the meat broiling restaurant industry have been disappointing, because of the effect on heat transfer efficiency from grease build-up on the heat transfer surfaces in contact with the meat broiler airborne exhaust effluent. Others have tried to solve this problem by using a washing system on the tubes and fins or the like of such heat transfer devices, but have found that expensive, messy and impossible to use in cold freezing weather, since that equipment is all out on the roof.

SUMMARY OF THE INVENTION

In a preferred form a restaurant meat broiling range hood is integrated with a fiber bed-type mist eliminating apparatus. Assistance is provided in the preferred form by a pump to draw the gas stream through this apparatus. Electrical and plumbing control systems are shown provided as substantially pre-assembled units for ease of field installation. A unique cleaning system is provided, which is simple to conduct.

The range hood emission control system of the invention is suitable for building into new restaurants as original equipment. It is also particularly suited for easy retrofitting of operating restaurants.

The principles of the invention will be further discussed with reference to the drawings wherein a preferred embodiment is shown. The specifics illustrated in the drawings are intended to exemplify, rather than limit, aspects of the invention as defined in the claims.

BRIEF DESCRIPTION OF THE DRAWING

In the Drawing

FIG. 5 is a more comprehensive electrical system diagram; and

FIGS. *6a–6d* simply illustrate some various other possible attitudes and complements of the basic components of the range hood emission control system of the invention.

FIG. 7 is a chart of a typical cycle of operation of a grill equipped with the cleaning system of the invention.

DETAILED DESCRIPTION OF THE PRESENTLY PREFERRED EMBODIMENT

Figure 1:
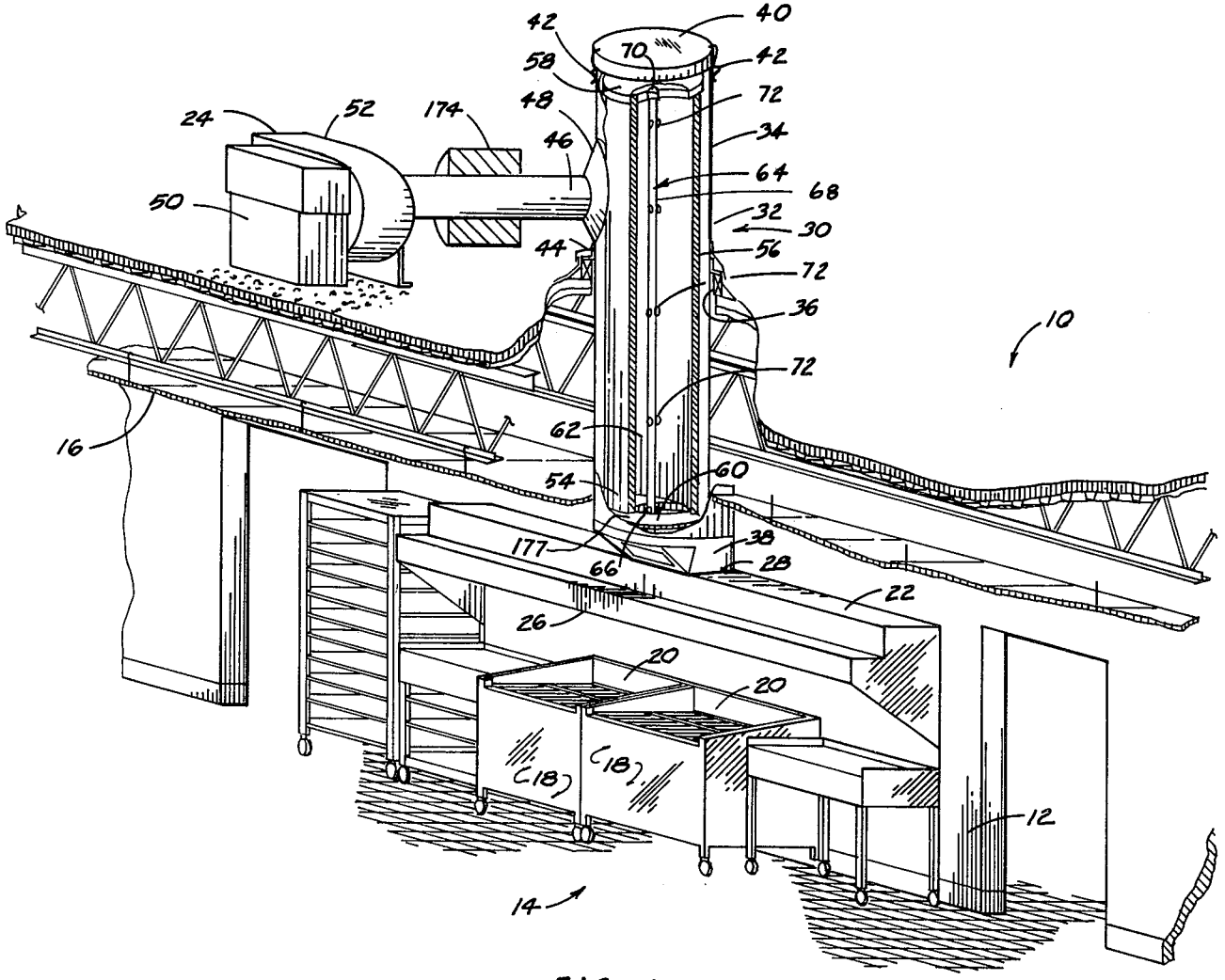
FIG. 1 is a perspective cut-away view of a restaurant broiling area equipped with a range hood emission control system of the present invention.
Figure 2:
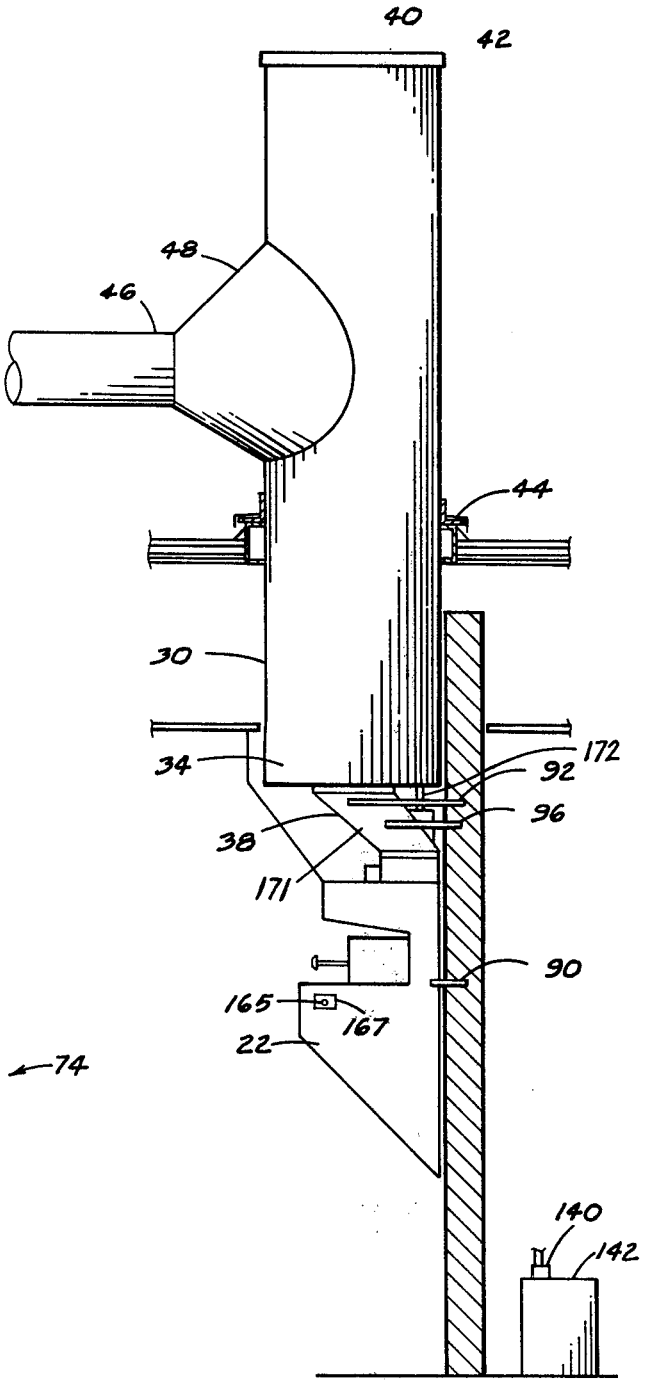
FIG. 2 is a fragmentary longitudinal cross sectional view on line 2—2 of FIG. 1.

The restaurant 10 of FIGS. 1 and 2 includes an interior wall 12 in the broiling area 14, and a roof 16. In the broiling area 14, there is at least one broiler 18. (In the instance shown, there are two broilers 18, which typically are units in which gas burners heat ceramic briquettes supported below the cooking grills 20.) Heat is radiated from the briquettes to the meat patties or other food slabs or the like while the food is supported on the grills 20.

A range hood 22 is provided over the broilers 18 to collect the airborne emissions rising from the broilers 18.

Some typical constituencies of the airborne emissions from restaurant meat broiling operations are reported in the aforementioned document of Ear, and are othewise publically available.

The present invention may be used in conjunction with range hoods presently commercially available, installed and in use in restaurant meat broiling areas. One suitable range hood is the Gaylord ventilator range hood equipped with a Gaylord grease extractor.

In general, a range hood is an exhaust inlet for collecting airborne emissions from the cooking processes carried out below it. Often range hoods are constructed of sheet metal and a supporting metal framework, and connect with an exhaust outlet, located exteriorly of the restaurant, e.g. on the roof at 24.

Typically, an exhaust fan is provided between the exhaust hood and the exhaust outlet to assist in drawing the exhaust up the exhaust hood and out the exhaust outlet. It is further conventional to spray a curtain of water in contact with the airborne exhaust emissions within the hood for recovering some water-soluble and water-wetted constituents from the airborne exhaust emissions. The aforementioned document of Ear describes a way of reducing odor emissions from restaurant meat broiler exhaust outlets, by spraying an oxidizer for some odorous constituents, into the airborne exhaust emissions within the range hood. The comparable provisions of the system of the present invention are described later in the present text.

Of present interest, note that the range hood 22 has a large inlet 26 covering the meat grilling region like a canopy, and focusses to a smaller outlet 28.

Usually an exhaust duct extends up from the range hood outlet 28, through the roof 16 to outdoors in conventional broiling systems which provide no further exhaust emission control downstream of the range hood. But here, that duct work has been vastly improved by the incorporation of a fiber bed-type mist eliminating apparatus 30 therein.

The mist eliminating apparatus 30 includes a housing 32 shown comprising a generally tubular shroud 34, which in this instance extends vertically upwardly from above the range hood outlet 28, and out through an opening 36 provided in the roof 16.

A transitional section of ducting 38 is provided for connecting the housing shroud 34 to the range hood outlet 28. A cap 40 is provided for closing the upper end of the housing shroud 34. The cap 40 is shown held removably in place, by clamps 42.

The housing is supported at 44 with respect to the building.

Above the roof 16, the housing shroud 34 is intersected generally horizontally by an elongated duct 46 (including an annular transitional section 48).

An exhaust fan 50, is mounted on the roof 16, and its housing 52 provides the exhaust outlet 24.

The outer end of the duct connects with the inlet side of the exhaust fan 50 via the housing 52.

Within the housing 32, there is coaxially mounted at 54 a tubular fiber bed element 56, baffled at 58 and 60 so that all of the airborne emissions which enter the housing 32 must pass axially within the lumen 62 of the fiber bed element 56, and pass radially through to the outside of the fiber bed element 56, in order to pass from the housing 32, through the duct 46.

The upper baffle 58 is shown provided in the form of a removable cap fitted on the upper end of the tubular fiber bed element 56.

A wash rack 64 extends in the lumen 60 and is mounted in the housing 32 at 66. The wash rack 64 is shown comprising an axially extending pipe 68, capped at the outer end 70, and provided at several axially spaced points within the lumen 60 with spray nozzles 72 so oriented that cleaning liquid may be sprayed over the whole of the interior of the fiber bed element from those nozzles.

Elsewhere in the restaurant 10, near the meat broiling area, e.g. on the opposite side of the wall 12 from the range hood 22, are provided a control panel 74 for the electrical system 76 and a control panel 78 for the plumbing system 80.

It is preferred that the system provided by the invention be manufactured in a few preassembled sections for ease of installation in the field. For instance, beyond the range hood 22, the system may include the following largely preassembled units: the mist eliminating apparatus 30, the exhaust duct 46, the exhaust fan 50, the electrical control panel 74 and the plumbing control panel 78. Once these units are mounted in place, they are connected, typically as follows: The exhaust fan 50, the range hood 22 and the plumbing control panel 78 are electrically connected to the electrical control panel, as is further described below in relation to FIG. 4. The mist eliminating apparatus 30 and the range hood are piped to the plumbing control panel 78.

The electrical control panel is connected to the building electric utility service and the plumbing control panel is connected to the building hot and cold water lines. (It is suggested that where the building water pressure is below 45 p.s.i., that a booster pump be included in the plumbing service for the plumbing control panel for boosting input to that magnitude.) The plumbing control panel is also connected to a drain to the building sanitary sewer service.

Further details of the system are now described in connection with the plumbing and electrical systems shown schematically in FIGS. 3 and 4.

Figure 3:
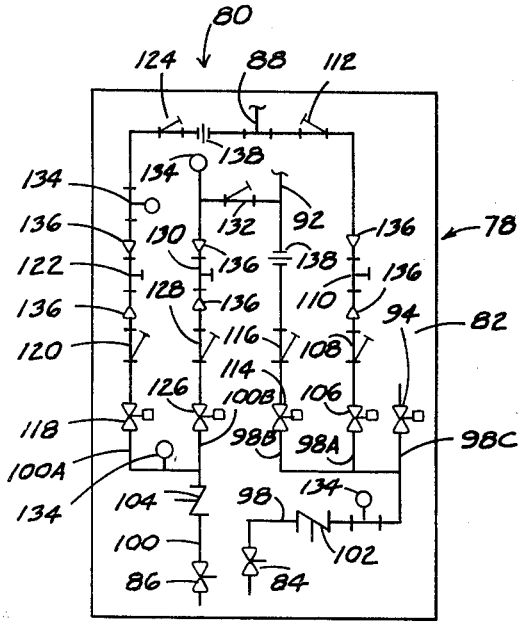
FIG. 3 is a schematic plumbing system diagram of the range hood emission control system.

Referring to FIG. 3, the plumbing system 80 includes a preassembled panel comprising a board 82.

The valve 84 is plumbed to the building cold water service (via a booster pump, if the cold water service pressure is below 45 p.s.i.).

The valve 86 is plumbed to the building hot water service (also via a booster pump, if the hot water service pressure is below 45 p.s.i.).

The outlet leg of the tee 88 is plumbed to the existing range hood nozzles 90.

The nipple 92 is plumbed to the inlet end of the wash rack pipe 68 to serve the spray nozzles 72.

The outlet side of the solenoid valve 94 is plumbed to mist control nozzles 96 disposed in the throat of the transitional section 38 between the shroud 34 and the hood 22.

The short segments 98, 100 of cold and hot water service lines provided on the panel 82 downstream from the valves 84, 86 are provided with respective backflow preventers 102, 104. Drain lines are plumbed from the taps of the backflow preventers 102, 104 to a sink or open site drain.

Downstream from the backflow preventer 102, the cold water service line 98 divides into three branches, 98A, 98B and 98C. The branch 98A passes through a solenoid valve 106, a check valve 108, a detergent injector 110 and a check valve 112 before connecting with one inlet leg of the tee 88. The branch 98B passes through a solenoid valve 114 and a check valve 116 before connecting with the nipple 92. The branch 98C connects with the inlet side of solenoid valve 94.

Downstream from the backflow preventer 104, the hot water service line 100 divides into two branches, 100A and 100B. The branch 100A passes through a solenoid valve 118, a check valve 120, a detergent injector 122 and a check valve 124 before connecting with the other inlet leg of the tee 88. The branch 100B passes through a solenoid valve 126, a check valve 128, a detergent injector 130 and a check valve 132, before also connecting with the nipple 92.

Plumbing control panel water service line items 134 are pressure gages; items 136 are reducers for the injectors and items 138 are unions.

The inlet taps of the detergent injectors are piped to a probe 140 designed to be immersed in a container 142 of detergent solution.

A presently preferred detergent solution is compounded as follows:

5 to 50 percent by weight of a mixture of water soluble salts including carbonates, chlorides and sulfates and hydroxides of alkali metals having an average molecular weight in the range of 30 to 76.

From 2 percent to about 30 percent by weight of a water soluble organic sequesterant.

From 2 percent to about 20 percent by weight of an organic and inorganic water soluble chelating agent.

From 2 to 15 percent by weight of the water soluble hydroxide of an alkali metal having an average molecular weight in the range of 30 to 76.

Sufficient water to solubilize the crystalline organic and inorganic salts.

Less than 10% of an organic surfactant to reduce surface tension.

Accordingly, the plumbing system is arranged to serve the range hood nozzles 90 with hot and/or cold water, each with or without injected detergent, further arranged to serve the wash tree spray nozzles with hot water with or without injected detergent and/or cold water, and further arranged to serve the mist control nozzles 96 with cold water.

(Building water service pressure typically may vary from 20–100 p.s.i. and available hot water may vary from 130°–180° F., and sometimes more. Detergent effectiveness may vary with water temperature. Providing both hot and cold water line connections to the range hood wash nozzles, each line preferably with its individual detergent injector permits tailoring injection rates to water temperatures, providing a uniform temperature output from a varying temperature hot water source by mixing appropriate amounts of cold water therewith, and even providing for more elaborate cycles than presently is preferred. For instance, the respective injectors and solenoid valves could be timed with commercially available timers such as are used in automatic clothes washers to provide a warm wash followed by a hot rinse.)

The electrical system 76 is constructed and arranged to provide control over which nozzles are served with what at which times.

The electrical system control panel 74 includes a prewired box 144 with a normally closed, hinged cover 146.

In general, the system provided by the invention is engineered so that once it is installed and adjusted for conditions present in the particular restaurant, it is very simple to operate and to monitor. Thus, a typical panel cover 146 is provided with a first switch actuator button 148 marked START and a second switch activator button 150 marked STOP. A series of six indicator lights 152, 154, 156, 158, 160, 162 is marked WASH, SOAK, RINSE, POWER ON, SYSTEM ON and DETERGENT LEVEL. The panel cover instrumentation as shown is completed by a local fire alarm switch 164 and a pressure differential indicating meter 166 for showing the pressure drop across the mist eliminator fiber bed element 56, from pressure taps in the exhaust effluent stream.

In general, once the system has been installed and adjusted, the operator need only push the buttons 148 and 150 at appropriate times, and provide a filled container of detergent 142 when the indicator light 162 shows that the existing container is nearly empty.

The electrical system 76, including the prewired portion within the electrical control panel box 144 is shown schematically in FIG. 4 to include electrical terminals 1E through 25E, including some terminals which are spares or which are optionally used as further explained below.

In a typical installation, the electrical terminals are wired to the system as follows:

| TERMINAL NOS. | ARE WIRED TO |
|---|---|
| 1E and 2E | hood hot water solenoid valve 118 |

-continued

| TERMINAL NOS. | ARE WIRED TO |
|---|---|
| 3E and 4E | starter coil of fan 50 and mist control cold water solenoid valve 94 (wired in parallel) (In addition, optionally, a toggle switch 165 is provided in a moisture-proof box 167 on the hood 22 in series with the hood cold water solenoid valve 106, and this loop: terminal 3E, to switch 164, to line 3A, to solenoid valve 106, to terminal 4E is also wired in parallel with items 50 and 94). |
| 5E and 6E | wash rack hot water solenoid valve valve 126 |
| 7E | spare |
| 8E and 9E | optional water pump booster, if used |
| 10E and 11E | wash rack cold water solenoid valve 114 |
| 12E and 13E | damper coil 168 of hood 22 |
| 14E and 15E | optional fire switch (not shown), if used |
| 16E and 17E | thermostat 170 of hood 22 (17E is jumpered to 12E via 17A in the panel and emerges via jumper 17B at the hood terminal block 172) |
| 18E and 19E | terminals of hood 22 blower motor actuating switch 174 |
| 20E and 21E | liquid detergent supply level indicator 175 (linked by lines 176, 178 to the probe 140) |
| 22E and 23E | control power supply for electrical control panel (typically: 120v, 60 cycle, single phase 10 amp.), and control power supply for liquid detergent supply level indicator 164 |
| 24E and 25E | spares |

Control relays, adjustable timers and fuses are provided, as indicated in the legend and key of FIG. 5.

Once the system is wired and plumbed, various adjustments are made to facilitate easy, proper operation.

If it were not for the mist control (cold water to nozzles 96 via solenoid valve 114) aerosol fats and char would contact the fiber bed 56 at 230°–260° F. Many particles would be in the lower end of the mist range (which is approx. 0.01–10.0 microns diameter) and difficult to trap. Many particles that are trapped at so high a temperature will bake onto the fiber bed and become a hard deposit that is difficult to remove.

Accordingly, the mist control system is operated to provide a spray of cold water into the effluent stream before the stream contacts the fiber bed. By preference, the spray is operated so long as the grill is operating, at a rate sufficient to drop the effluent stream to approximately 110°–120° F. prior to contact with the fiber bed. The cooling spray also causes many of the small particles to clump together, increasing collection efficiency significantly.

The exhaust fan 50 typically is designed so that when used in conjunction with the hood 22, an exhaust effluent flow rate of about 250 cubic feet per minute per foot of hood width is maintained. For a typical four foot hood, the flow rate is thus about 1000 cubic feet per minute.

However, the exhaust fan 50 must exert a significant pull on the exhaust effluent stream in order to infiltrate the fiber bed with the system-cleaning detergent solution. The fan 50 is designed to exert a suction equal to a manometer reading of ten inches of water.

The system is designed so that at the beginning of a work day, the operator pushes the START button 148, which initiates a washing of the hood 22, via the nozzles 90, served by cold and hot water lines 98A, 100A, into which detergent solution is injected at 110, 122. A typical wash time is 1 to 10 minutes. The timer for this cycle shows schematically in FIG. 5. The spent detergent solution and its burden are drained from the hood via the drain line 169.

When, at the end of an operating period the grill is turned off and the operator pushes the button 150 marked STOP, the system begins to shut down: The fiber bed element is washed, permitted to soak, and rinsed, all automatically while remaining in place, a process which typically takes about two to eighteen minutes. In the washing operation, the caustic detergent solution in water provided through the lines 98B, 100B is sprayed from nozzles 72 onto the inner wall of the fiber bed element 56 covering the lumen 62 surface. The fan 50 is operated to pull the detergent solution thoroughly into the element 56. During the soak, the fat is converted to soap by the cleaning solution and the char is broken down. The spent wash draining from the lumen of the fiber bed element is led out a drain line 171, then the element 56 is permitted to soak. Finally, rinsing water is sprayed from the nozzles 72 and the fan 50 is operated to pull the increasingly dilute spent wash liquid through the fiber bed element, where it is collected and drained from the system at 172. (Were it not for the suction and air flow created by the fan, the fiber bed would remain laden with detergent solution, emulsified fats and fragments of char, and would soon become seriously plugged). Typically, the fan 50 provides a face velocity of 1–80 FPM through the fiber bed element.

Typically, so much of the grease, char and particles are removed from the exhaust stream issuing into the duct from the fiber bed element, that the exhaust stream and/or the duct may be successfully interfaced with a heat pump, heat exhanger or similar waste heat recovery device e.g. as at 180, for use elsewhere in the restaurant.

In order to reinforce the completeness of the best mode described herein, the following are given as non-limiting examples of some important items of equipment which may be used in the practice of the invention. In the typical embodiment illustrated, the hood 22 is a Gaylord ventilator by Gaylord Industries. The mist eliminating apparatus 30 is a Brink mist eliminator by Monsanto. The sealing gasket 177 between the fiber bed element 56 and its housing is typically made of Teflon fluorocarbon-impregnated African Blue asbestos, to ensure that none of the exhaust gas stream entering the housing can exit bypassing the fiber bed element.

A typical rate of injection of the above-described illustrative liquid detergent solution is one ounce per gallon of wash water for the cleaning hood 22 and the mist eliminating apparatus 30.

For a typical flow rate of 9.50 gallons per minute at 60 p.s.i. water pressure, about nine ounces of cleaning solution will be injected into the hood cleaning nozzle supply per minute of operation. Thus, a typical six minute start-up cleaning operation for the hood will consume about fifty-four ounces of liquid cleaner drawn from the container 142.

For a typical flow rate of 10.98 gallons per minute at 60 p.s.i. water pressure, about eleven ounces of cleaning solution will be injected into the fiber bed element cleaning nozzle supply per minute of operation. Thus, a typical six minute close down cleaning operation for the mist eliminating apparatus will consume about 66 ounces of liquid cleaner drawn from the container 142.

Typically, the pressure drop across the fiber bed is equivalent to about a 5 or 6 inch water manometer reading, when clean and dry, and about a 8 or 9 inch reading when washed, soaked and rinsed, but still wet.

The blower 50 may be a Chicago Airfoil SQA fan by Chicago Blower Corporation, turned by an electric motor via an endless V-belt entrained about adjustable sheaves.

The detergent injectors may be Dema jet pump injectors by Dema Engineering Company.

The wash and rinse spray nozzles may be FullJet wide angle spray, hydraulic atomizing nozzles.

The backflow preventors 102, 104 may be Watts Series 9D Backflow preventers, by Watts Regulator Company.

Figure 4A:
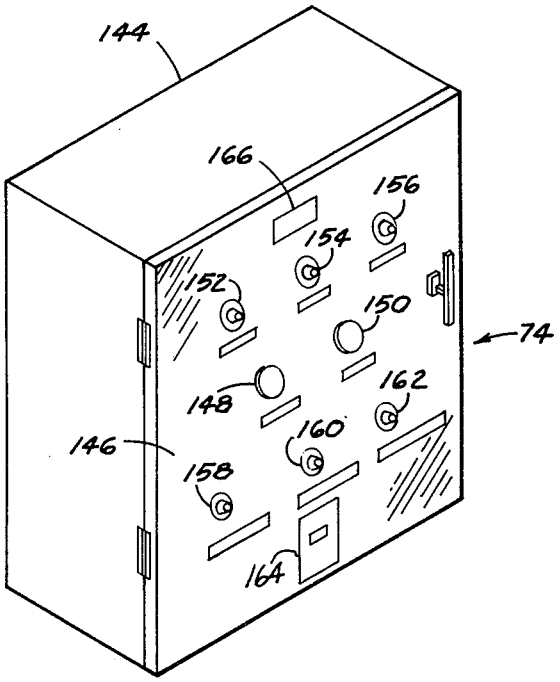
FIG. 4 is a simplified schematic electrical system diagram thereof.
Figure 4B:
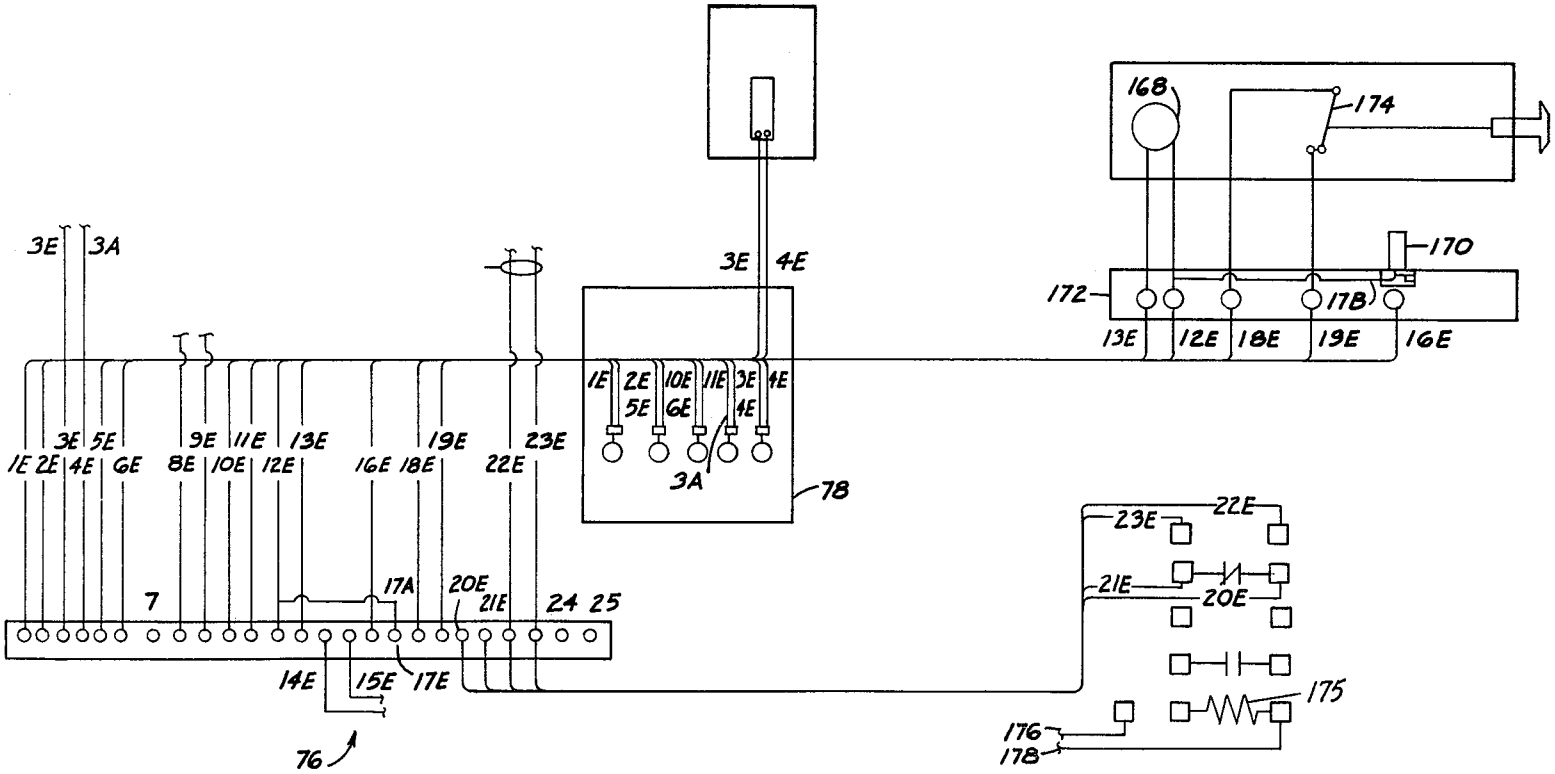
Figure 6A:
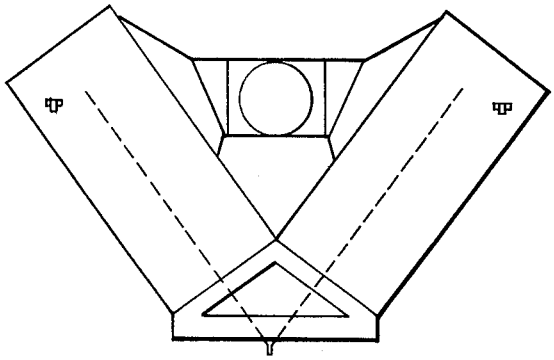
Figure 6B:
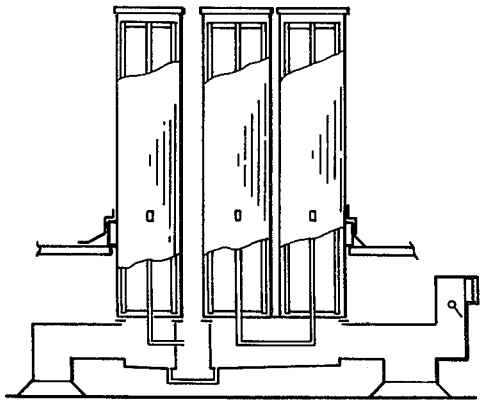
Figure 6C:
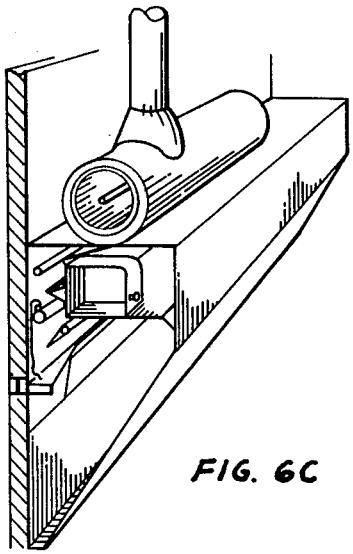
Figure 6D:
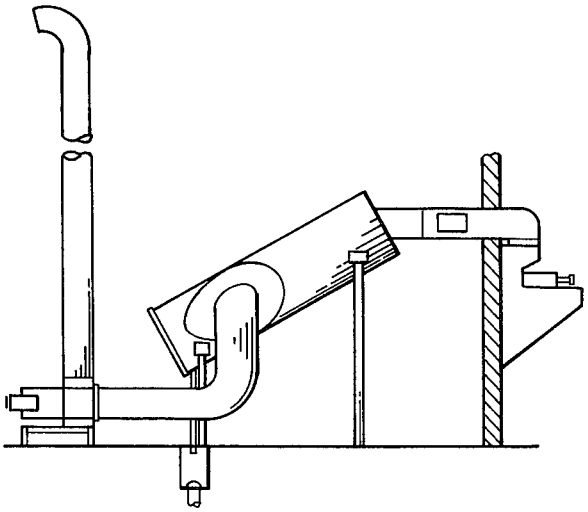

The entire assembly identified in FIG. 4 as the detergent liquid level control of the electrical system is sold as a ready-made, commercially available unit, for instance a type B 2DXXX liquid level control supplied by Charles F. Warrick Co.

The solenoid valves 94, 106, 114, 118 and 126 may be ASCO 2-way, normally closed, internal pilot-operated, hung diaphragm solenoid valves by Automatic Switch Company.

The pressure differential gage and indicating meter 166 may be a Series 5000 Minihelic gage by Dwyer Instruments, Inc.

The sequence of operations in using the system embodiment described by way of example is as follows:

If terminals 22E and 23E are being supplied with electricity the POWER ON light 158 should be lit, unless the circuit breaker provided as a safety measure has tripped out or the bulb for the light 158 has burned out.

When the START button 148 is pushed, the SYSTEM ON light 160 will light and the timer (FIG. 5) for the range hood wash cycle will be energized. The hood will be washed for the preset time set on the respective timer. At the conclusion of the preset time, hood washing will cease and the exhaust fan 50 will start.

Typically, a range hood/mist eliminator air quality control system could be run up to three days without cleaning the fiber bed element. The element would become increasingly plugged and more difficult to eventually clean. The mist eliminator cleaning system provided by the invention is so easily initiated, so automatically operated and a full cleaning cycle so brief when regularly frequently conducted, that it may be conducted several times a day, e.g. each time the grill is shut down after a period of intense grilling connected with a mealtime. In other instances it will be sufficient to clean the mist eliminator once per work turn or once per day.

To initiate cleaning of the fiber bed element of the mist eliminator, the grill is closed down and the STOP button 150 is pushed.

Then, detergent solution in water of pre-selected temperature is sprayed within the lumen of the fiber bed element from the wash tree nozzles. The fan 50, continuing to operate, pulls the detergent all the way into the radial thickness of the fiber bed element. This continues for the time set on the respective timer shown in FIG. 5. Then spraying stops and the fan 50 continues to run. At the conclusion of the soak period, the wash tree nozzles will spray a cold water rinse upon the fiber bed element and the fan 50 will operate to pull the rinse water completely into the radial thickness of the fiber bed element, thus diluting the spent wash and carrying away the saponified fats and char debris.

As is apparent from FIG. 5, if there is a fire, if the fan 50 fails, if the hood temperature sensed by the range hood thermostat becomes too high, or if the damper in the hood is manually tripped to close, the fan will stop if not stopped and the damper will close if not closed. Then the hood nozzles will spray cold water and the fan will not run, at all, until the thermostat indicates a safe operating temperature. When the thermostat opens, the cleaning system will revert to a POWER ON condition, ready for operation of the grill.

Other workable arrangements for the major components of the cleaning system are shown in FIGS. *6a–6d.*

It should now be apparent that the control of range hood emissions as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. Apparatus for control of range hood airborne emissions, comprising:

a mist eliminator fiber bed element;

a housing for said fiber bed element, having an inlet and an outlet;

gasket means sealing between said fiber bed element and the housing intermediate the inlet and the outlet, so that all airborne emissions entering the housing, from the range hood, must pass through said fiber bed element in order to reach said outlet;

an exhaust fan associated with said outlet;

airborne emissions cooling spray means associated with said inlet, for substantially lowering the temperature of said emissions prior to their contact with said fiber bed element to reduce the tendency of constituents of said emissions to bake onto said fiber bed element, and to decrease the number of smallest size particles in the emissions by effecting combinations of said particles;

means for perfusing the fiber bed element, in situ, successively with a liquid cleaning solution for saponifying fats and breaking-up char, then a liquid rinse for flushing out the spent liquid cleaning solution and its burden of saponified fats and char debris;

the perfusing means including control means arranged to operate said blower means automatically both while said perfusing means is perfusing the fiber bed element with said liquid cleaning solution and while said perfusing means is perfusing the fiber bed element with said liquid rinse; and drain means from the housing for draining spent liquid cleaning solution and liquid rinse therefrom.

2. The apparatus of claim 1, comprising:

(a) first nozzle means aimed to spray within the range hood;

(b) second nozzle means aimed to spray upon the fiber bed element and constituting part of said perfusing means;

(c) and third nozzle means aimed to spray into the range hood airborne emissions in the vicinity of said inlet and constituting part of said cooling spray means;

cold water supply means;

hot water supply means;

a reservoir for liquid cleaning solution;

a panel-mounted modular plumbing system subassembly;

a panel-mounted modular electrical system subassembly;

the modular plumbing system including:

a cold water line which divides into a first branch for serving the first nozzle means, a second branch for serving the second nozzle means and a third branch for serving the third nozzle means;

a hot water line which divides into a first branch for serving the first nozzle means and a second branch for serving the second nozzle means;

injector means associated with at least one said branch for each of said first nozzle means and second nozzle means, each for injecting said liquid cleaning solution into the respective branch; and automatically operable valve means for each said branch and timer means associated with each said valve means;

conduit means connecting the liquid cleaning solution reservoir with each said injector;

conduit means connecting each said branch with the respective said nozzle means;

the modular electrical system including:

terminal means connectable with an electric power supply, for providing electrical power to said apparatus;

electrical connection means for connection between said terminal means and each respective automatically operable valve means;

electrical connection means for connection between said terminal means and said exhaust fan;

a first control system including an actuator which, if actuated, initiates a cycle in which at least one of said cold water line first branch and said hot water line first branch first supply water with injected liquid cleaning solution to the first nozzle means for washing the range hood, then supply water without injected liquid cleaning solution to the first nozzle means for rinsing the range hood, then supply electrical power to operate said exhaust fan; and a second control system including an actuator which, if actuated, initiates a cycle in which at least one of said cold water line second branch and said hot water line second branch first supply water with injected liquid cleaning solution to the second nozzle means for perfusing said mist eliminator fiber bed element while continuing to supply electrical power to operate said exhaust fan, then terminating said supply to the second nozzle means while exhaust fan operates to permit the fiber bed element to soak, thirdly supply rinse water to the second nozzle means for flushing the fiber bed element and supply electrical power to the fan to draw the rinse water completely through the fiber bed element, and finally terminate said supply of rinse water to the second nozzle means.

3. In a work station-serving system for collecting and processing an exhaust gas stream emanating from a process to be conducted at the work station in which an oily, greasy or fatty material is being heated, for removing potentially air-polluting mist and char from the exhaust gas stream when said exhaust gas stream is emanating into said system at an elevated temprature which lies above a known threshold temperature, before the exhaust gas stream is vented to the atmosphere, apparatus comprising:

a mist eliminator fiber bed element having a capacity to filter substantial amounts of said potentially air-polluting mist and char from said exhaust gas stream when said exhaust gas stream is constrained to pass through said mist eliminator fiber bed element, provided said exhaust gas stream when coming into contact with said mist eliminator fiber bed element lies below said known threshold temperature;

conduit means housing said mist eliminator element intermediate upstream and downstream ends of said conduit means;

said conduit means having the upstream end thereof open for accepting said elevated temperature, above said known threshold temperature, exhaust gas stream;

said conduit means having the downstream end thereof open for discharging to the atmosphere said exhaust gas stream after said exhaust gas stream has been cooled to below said known threshold temperature and has passed through said mist eliminator fiber bed element;

wall means in and forming part of said conduit means for constraining all of the exhaust gas stream entering at said upstream end to pass through said mist eliminator fiber bed element before such exhaust gas stream is vented to the atmosphere;

cooling water spray means having spray nozzle means thereof provided within said conduit means between said upstream end and said mist eliminator fiber bed element, for lowering the temperature of said exhaust gas stream by direct contact, adiabatic cooling thereof, to below said known threshold temperature, upstream of said mist eliminator fiber bed element; and suction blower means incorporated in said conduit means downstream of said mist eliminator fiber bed element, for maintaining when operating, enough of a pressure differential across said mist eliminator fiber bed element as to tend to draw said exhaust gas stream through said mist eliminator fiber bed element.

4. The apparatus of claim 3, wherein said known threshold temperature is one at which at least some fatty mist will congeal from said exhaust gas stream onto said mist eliminator fiber bed element, said apparatus further including:

spray tower means within said conduit means and juxtaposed with the upstream side of the mist eliminator fiber bed element for successively spraying a detergent solution and rinse water upon the mist eliminator fiber bed element for saponifying and breaking up what has been removed from the exhaust gas stream and has become embedded in and caked upon the mist eliminator fiber bed element, while the mist eliminator fiber bed element remains in situ;

control means arranged to operate said suction blower means automatically both while said spray tower means is spraying said detergent solution and said rinse water upon the mist eliminator fiber bed;

and drain means communicated with said conduit means downstream from said mist eliminator fiber bed element, for draining from the conduit means spent detergent solution and wash water and such debris as has become entrained therein, all of which have been drawn through the mist eliminator fiber bed element due to spraying through said spray tower means and automatically operating said suction blower means simultaneously therewith.

5. The apparatus of claim 4, further including:

an automatic output shut off means, for providing a shut-off control signal as an output thereof when a preselected command is received thereby;

means for sensing the pressure drop across said mist eliminator fiber bed element and for providing said preselected command when it is sensed that, in effect because the mist eliminator fiber bed element has become so clogged that it needs cleaning as a first order of business, normal operation of the suction blower means has created an unusually low pressure in the conduit means downstream of the mist eliminator fiber bed element and thus is drawing less effectively upon the exhaust gas stream within the conduit means upstream of the mist eliminator fiber bed element.

6. The apparatus of claim 4, further including:

additional drain means communicated with said conduit means upstream from said mist eliminator fiber bed element, for draining from the conduit means spent detergent solution and wash water and such debris as has become entrained therein and tended to drain within said conduit means but on the upstream side of said mist eliminator fiber bed element.

7. The apparatus of claim 4 wherein:

the system is one for processing a commercial cooking exhaust gas stream which is to become available to said apparatus at an elevated temperature which is above about 230° F.; and the cooling water spray means when operating thereon is sufficient to reduce said elevated temperature of said commercial cooking exhaust gas stream to at least as low as 120° F. before said commercial cooking exhaust gas stream impinges upon said mist eliminator fiber bed element.

8. The apparatus of claim 4, wherein:

said conduit means, at the upstream end thereof comprises a commercial cooking work station exhaust hood which converges downstream toward a cylindrical housing;

said mist eliminator fiber bed element being of cylindrical, tubular form and being coaxially disposed in said cylindrical housing, said wall means being so arranged relative to said mist eliminator fiber bed element and said cylindrical housing that the upstream side of said mist eliminator fiber bed element ends radially centrally of said mist eliminator fiber bed element and the downstream side of said mist eliminator fiber bed element begins radially between said mist eliminator fiber bed element and said cylindrical housing.

9. The apparatus of claim 8, wherein:

said conduit means exits transversally from said cylindrical housing intermediate the axial extent of said cylindrical housing.

10. The apparatus of claim 9, wherein:

said cylindrical housing is vertically oriented.

11. The apparatus of claim 9, wherein:

said cylindrical housing is horizontally oriented.

12. The apparatus of claim 9, wherein:

said cylindrical housing is obliquely oriented.

13. The apparatus of claim 8, further including:

said conduit means further includes a transitional portion connecting between said exhaust hood and said cylindrical housing;

said cooling water spray means spray nozzle means being located to spray cooling water into said commercial cooking exhaust before said commercial cooking exhaust gas stream upstream of the upstream end of said cylindrical, tubular mist eliminator fiber bed element; and said spray tower means extending substantially lengthwise of and being disposed radially centrally of said cylindrical, tubular mist eliminator fiber bed element.

14. Pollution control apparatus for removing what otherwise would become visible emissions to the atmosphere from the ventilating system of a cooking area for fatty foods, comprising:

a downwardly opening hood positioned above said cooking area;

a ventilation duct means connected at one end to the hood and having an opposite end open to the atmosphere away from said cooking area;

an aerosol particle coalescing filter enclosed within the ventilation duct means intermediate the ends thereof and a blower means interposed in said ventilation duct means downstream of said filter for drawing a hot, fat-containing gas stream resulting from cooking a fatty food in said cooking area, which gas stream has entered said hood, from the hood through the ventilation duct means, including through the aerosol particle coalescing filter and for discharging said gas stream to the atmosphere remotely of said cooking area after coalescing and removing from said gas stream aerosol particles including fatty aerosol particles by means of said filter;

said filter being a hollow mist eliminator body having an inlet opening into an internal space thereof;

said ventilation duct means including a filter housing in which said filter is mounted by mounting means which constrain all of said exhaust gas stream which enters said housing to pass into said internal space through said inlet opening, and then outwardly through the filter before said exhaust gas stream can pass out of said housing and become discharged to the atmosphere; means for collecting from the filter housing at least some of that which has been collected in said filter housing as a result of said coalescence and removal from said gas stream of aerosol particles including fatty aerosol particles by means of said filter;

said collecting means including drain means from said housing, which drain means communicate with said housing so as to be in communication with said internal space of said filter relatively upstream of said filter; and means for cooling the gas stream after the gas stream enters the hood but before the gas stream is drawn outwardly of said internal space through the filter, (a) from a first, higher temperature at which, if the gas stream were to be drawn outwardly through the filter there would be at least one of (i) a first, higher tendency for a significant amount of small particles of that which would become visible emissions remaining in said gas stream downstream of said filter and unremoved from said gas stream by said filter, and (ii) a first, higher tendency for particles trapped from the gas stream by said filter to bake onto the filter, (b) to a second, lower temperature at which at least one respective said first, higher tendency is substantially reduced to a second, lower tendency.

15. The apparatus of claim 14, wherein:

said means for cooling comprises means for spraying a cooling liquid into said gas stream at a sufficient rate sufficiently up stream of where said gas stream comes in contact with the filter while passing outwardly through the filter so as to cause said cooling from said first, higher temperature to said second, lower temperature;

said second, lower temperature being sufficiently low as to be one at which at least some of the fatty aerosol particles of said gas stream will congeal onto said filter.

16. The pollution control apparatus of claim 15, including:

means for saponifying in situ on and within the filter to the exterior thereof, at least some of that which has been collected in said filter housing as a result of said coalescence and removal from said gas stream of aerosol particles including fatty aerosol particles by means of said filter; p1 said means for saponifying including means for spraying a liquid detergent solution and thereafter a liquid rinse internally onto said filter from within said internal space;

and control means arranged to operate said blower means automatically both while said spraying means is spraying said liquid detergent solution and while said spraying means is spraying said liquid rinse, to pull the liquid detergent solution and then the liquid rinse through the filter to the exterior thereof with such as was collected on and in said filter that thereby becomes dislodged in and drains away with said liquid detergent solution and said liquid rinse exteriorly of the filter;

and drain means from said housing, which drain means communicates with the exterior of the filter.

17. The pollution control apparatus of claim 16, wherein:

said control means further including means for controlling said spraying means to automatically spray said liquid detergent solution for a first, washing time interval, to automatically cease spraying for a second, soaking time interval, and to automatically spray said rinsing liquid for a third, rinsing time interval.

18. The pollution control apparatus of claim 17, wherein:

said control means also is arranged to operate said blower means automatically during said soaking time interval.

* * * * *